US006222988B1

(12) United States Patent
Behrendt et al.

(10) Patent No.: US 6,222,988 B1
(45) Date of Patent: Apr. 24, 2001

(54) ELECTRICALLY DRIVEN HAIR CARE APPLIANCE

(75) Inventors: Jürgen Behrendt, Idstein; Wilfried Rolf, Eschenau, both of (DE)

(73) Assignee: Braun GmbH, Franfurt Am Main (DE)

( * ) Notice: Subject to any disclaimer, the term of this patent is extended or adjusted under 35 U.S.C. 154(b) by 0 days.

(21) Appl. No.: 09/230,708

(22) PCT Filed: Jun. 26, 1997

(86) PCT No.: PCT/EP97/03347

§ 371 Date: Jan. 29, 1999

§ 102(e) Date: Jan. 29, 1999

(87) PCT Pub. No.: WO98/08413

PCT Pub. Date: Mar. 5, 1998

(30) Foreign Application Priority Data

Aug. 26, 1996 (DE) ..... 196 34 422

(51) Int. Cl.[7] ..... F24H 3/00; A45D 20/10

(52) U.S. Cl. ..... 392/385; 34/97; 219/541

(58) Field of Search ..... 392/384, 385, 392/379; 219/541; 34/96–101

(56) References Cited

U.S. PATENT DOCUMENTS

| | | | | |
|---|---|---|---|---|
| 3,846,047 | * | 11/1974 | Wada et al. | 34/97 |
| 4,195,217 | | 3/1980 | Hoffmann . | |
| 5,241,974 | | 9/1993 | Tsai . | |
| 6,003,239 | * | 12/1999 | Liebenthal et al. | 34/97 |

FOREIGN PATENT DOCUMENTS

| | | | | |
|---|---|---|---|---|
| 9305195 | | 7/1993 | (DE) . | |
| 584948 | * | 11/1958 | (IT) | 392/385 |
| 590045 | * | 3/1959 | (IT) | 392/384 |
| 59-21227 | * | 2/1984 | (JP) . | |
| 7-51117 | | 2/1995 | (JP) . | |
| 92/10959 | | 7/1992 | (WO) . | |

* cited by examiner

*Primary Examiner*—John A. Jeffery
(74) *Attorney, Agent, or Firm*—Fish & Richardson P.C.

(57) ABSTRACT

The invention is directed to an electrically powered appliance for the treatment of hair, in particular a hair dryer, having a fan motor for generating a current of air and a heater unit for heating the air current, and a housing with an air inlet port and an air outlet port as well as a connector element, for connecting the hair dryer to an implement for hair treatment. This implement is equipped, particularly for the styling and/or drying of hair, with an electrical load, for example, an electric motor, and is attachable to the air outlet port of the hair dryer. The connector element includes at least one terminal device for electrical connection to a voltage-carrying component in the hair dryer. The terminal device electrically at selected locations is connected with the heater unit and is disposed essentially outside the heater unit.

21 Claims, 7 Drawing Sheets

ELECTRICALLY DRIVEN HAIR CARE APPLIANCE

BACKGROUND OF THE INVENTION

This invention relates to an electrically powered appliance for the treatment of hair, in particular a hair dryer, having a fan motor for generating a current of air and a heater unit for heating the air current and a housing with an air inlet port and an air outlet port as well as a connector element, for example, a plug-and-socket element for connecting, in particular electrically, the hair dryer to an implement for hair treatment. This implement is equipped, in particular for the styling and/or drying of hair, with an electrical load, for example, an electric motor, and is attachable to the air outlet port of the hair dryer. The connector element includes terminal devices for electrical connection to at least one voltage-carrying component in the hair dryer.

An appliance of this type is known from JP 7-51117. This specification describes a curling iron with a handle member and an accessory. Accommodated in the handle member are a fan and a heater unit. The accessory, for example, a round brush, contains further electrical components and is connectible with the air outlet end of the handle member by means of electrical connectors.

From DE-U-9305195.6 an electrically powered hair dryer is known which has a socket which is adapted to be connected with a plug of an implement operable by an electric motor.

In the manufacture of hair dryers and implements attachable thereto, particularly in the manufacture of large quantities and different types of hair dryer and implement, it has proven to be disadvantageous that, in order to combine a particular type of hair dryer with a particular type of implement, it is usually necessary that a connector element be constructed individually.

Considering that different types of additional implement are generally operated at different electric voltages, a relatively high engineering effort is involved in providing the respective operating voltage required by the particular implement on the hair dryer. Hence, for example, provision is made in the hair dryer to accommodate a wide variety of electrical components, in particular connectors, which are fitted to suit the particular hair-dryer-and-implement combination individually and in consequence have to be made available in the corresponding wide variety and also have to be assembled individually.

SUMMARY OF THE INVENTION

It is accordingly an object of the present invention to provide a simplified configuration of a connector element which is fitted to a hair dryer and suitable for establishing a connection with an additional implement. Particularly, it is desirable that the number of electrically conducting components necessary for the equipment of various types of hair dryer and the connection of different additional implements operating at different voltages be appreciably reduced for the connector element, and that the assembly of the connector elements be facilitated, hence enabling them to be produced more economically.

According to the present invention, this object is accomplished in an appliance incorporating the features described in the foregoing in that the terminal device is connected with the heater unit, in particular with the spiral coil heater, and is disposed essentially outside the heater unit. On the one hand, this connection of the terminal device with the spiral coil heater proposes a flexible possibility for making available the electric voltage necessary for the respective implement in simple manner. Thus it is possible, particularly by a voltage tapping using a terminal device on a spiral coil heater, to make available nearly any desired electric voltage that is lower than the supply voltage existing in the particular case. Hence it is no longer necessary to make provision for different electric terminal devices to accommodate different operating voltages; rather, these operating voltages are determined by the respective point of contact of the terminal device with the spiral coil heater. The requisite number of electrically conducting parts for the connector element, in particular the terminal device, is thus appreciably reduced. On the other hand, with the arrangement of the terminal device essentially outside the heater unit a simple assembly possibility is proposed, enabling the terminal device to be connected with the heater unit in a simple and positionally flexible manner after the spiral coil heater is wound. Advantageously, this results in greater economy of manufacture of the hair dryer, particularly of the electric connector element between the hair dryer and an additional implement.

In a particularly advantageous further feature of the present invention, the terminal device is routed from nearly any desired location on the outside through the housing wall of the hair dryer, in particular a heater tube, extending into the interior of the hair dryer where the terminal device is connected with the heater unit. Advantageously, there is thus proposed a particularly flexible connection possibility for the terminal device on the heater unit which, owing to the nearly free choice of the connecting point between the terminal device and the heater makes it possible to generate any desired electric voltage to be supplied to an additional implement. Furthermore, since the terminal device can be routed from outside through the housing wall, particularly through the heater tube, it is possible to accomplish an extremely simple and cost effective connection following fitting of the heater unit in the hair dryer.

In another further feature, the terminal device has its one end connected to a heat conducting wire of the heater unit, particularly the spiral coil heater. With this arrangement, an advantageous simple connection of the terminal device with a voltage-carrying component in the hair dryer is proposed which, by reason of the flexible choice of the point of contact of the terminal device with the heat conducting wire, makes it possible to provide the requisite electric voltage in simple manner.

In a further advantageous aspect of the present invention it is proposed providing the terminal device as an electric voltage tap using a standard component including standard variants. Accordingly, a standardized terminal device is of such geometrical shape that one and the same terminal device can be employed for the generation of a variety of electric voltages. This has the advantage of eliminating the need to provide individual terminal devices as heretofore required for the generation of different voltage values. It will be understood, however, that the standardized configuration of the terminal devices may also include a standardized variant, with the number of such standard variants being advantageously significantly lower than the heretofore required number of individual variants of the terminal devices.

In a particularly advantageous further feature, the terminal device comprises an electrically conducting bar and a contact terminal. A bar affords at its one end a simple possibility of establishing a connection with a further electric conductor arranged, for example, in an additional implement. At the other end of the bar a contact terminal may be connected with this bar, establishing an electrical connection to the electrical load, in particular a spiral coil heater. By reason of its elongated dimension the bar is thus advantageously capable of covering a large area of the spiral coil heater's turns and is therefore variable in the selection of the contact point of the contact terminal for generating the respective electric voltage.

The bar itself may be configured in particular as a straight bar or, alternatively, as a helical bar. In cases in which a straight bar configuration is selected, a particularly simple and cost effective variant is proposed; a helical bar configuration enables a nearly infinitely variable adjustment of an electric voltage for an additional implement.

In a further feature of the present invention, the bar is secured to the outside of the heater unit, particularly to the outside of a heater tube surrounding the heater unit. One effect of this arrangement is that it avoids a reduction in the area of cross section of the air exit in the interior of the dryer housing, thus also precluding any impairment of the air current by these contact members. Another advantageous proposal involves an attachment of the bar to the outside of the housing with extreme ease.

It is particularly advantageous to provide the bar with contact points, in particular with apertures, for fastening the contact terminals. The distance between two contact points on a straight bar then corresponds essentially to the axial distance between two turns of the heat conducting wire. This advantageously enables the contact terminal to be connected to the bar at nearly any desired location, particularly from the outside of the heater tube.

Alternatively to the straight bar configuration, the helical bar is designed with a lead corresponding essentially to the lead of the spiral coil heater. This enables a heat conducting wire of a spiral coil heater to be associated with a corresponding helical bar in simple manner, which bar is arranged particularly on the outside of a heater tube, hence enabling, by insertion of a contact terminal, a simple connection of the bar to the heater unit. In particular the helical configuration of the bar makes it possible to establish a connection to the heating wire at nearly any desired location, thereby making it possible for the electric voltage to be adjusted to nearly any desired value ranging from zero to the supply voltage of the appliance.

In a further aspect of the present invention, two straight bars are arranged essentially parallel to the direction of main flow of the hair dryer, and the contact terminal is insertable into a slotted opening in the dryer housing, particularly the heater tube, between the two bars. This has the advantage that the contact terminals are guided in a common slot in the heater tube for the connection of both bars. Depending on the location selected for the connection between the contact terminal and the turn of the heater unit, the necessary electric voltage is adjustable on the bars.

One end of the bar, advantageously the end pointing in the direction of the air outlet port of the hair dryer, has a contact slot, a contact pin or a contact tab for connection with the implement. This has the advantage of enabling a simple connection of a further connector element of an additional implement with the bar of the hair dryer.

In an advantageous configuration the contact terminal has its one end formed in the manner of a blade tap having at least two blades adapted to be push-fitted onto the heat conducting wire of the heater unit. Upon insertion of the terminal into the slotted opening of the heater tube, a simple connection between the terminal and the heat conducting wire of the heater unit can thus be established to advantage.

At its other end the contact terminal includes a contact tab which, for example, is angled relative to the blade tap and is connectible with the bar. This has the advantage of enabling a terminal, upon insertion into the slotted opening of the heater tube, to be connected with the heat conducting wire and the bar at the same time. Further connectors between the terminal and the bar and further operations for connecting the terminal are no longer necessary.

In a further feature of the present invention, the bar and the contact terminal are constructed as die castings or sheet metal stampings. This affords ease of manufacture of bar and terminal in addition to enabling mass production of bars and contact terminals economically.

It is particularly advantageous to form the bar and the contact terminal as an integral component. This may involve, for example, manufacturing the bar as a sheet metal stamping formed to standard shape by a stamping die, and providing the contact terminal at various locations on the bar using adjustable die inserts.

In a particular further feature of the present invention, the bar is connected to a hair dryer component carrying the supply voltage. Advantageously it is thus possible to provide for direct electrical connection between a hair dryer and an additional implement which is operable on supply voltage.

A particularly advantageous method relates to the step of electrically connecting a connector element with a terminal device identified in the foregoing. In this method, the connector element is intended to connect an electrically powered appliance for the treatment of hair, particularly a hair dryer, with an implement for hair treatment. It is of particular advantage that the terminal device, in particular a contact terminal, is routed from outside at nearly any desired location through the housing wall of the hair dryer, in particular the heater tube, into the interior of the hair dryer and is connected with the heater unit, in particular the spiral coil heater. This provides a flexible possibility of electrically connecting a heater unit, in particular a spiral coil heater, from outside after the coil is wound.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back-reference.

DETAILED DESCRIPTION

Figure 1:
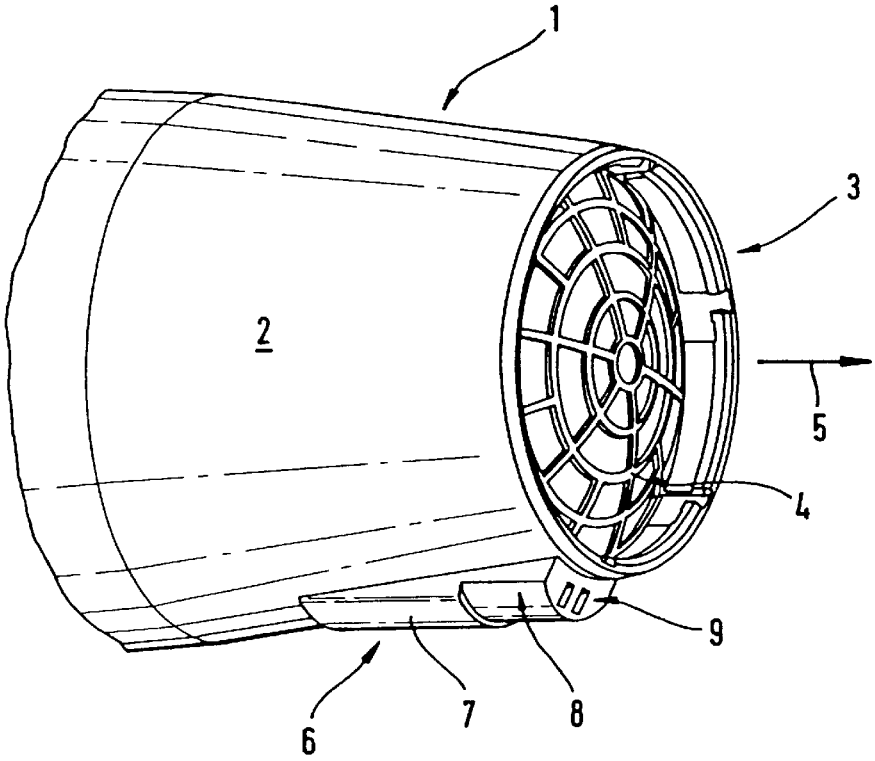
FIG. 1 is a perspective view of the air outlet end of a hair dryer showing a connector element.

The air outlet end of a hair dryer 1 (FIG. 1) is substantially comprised of a heater tube 2 with an air outlet port 3 in which an air outlet screen 4 is inserted. An air current is moved through this heater tube in the direction of main flow 5. Provided on the underside of the heater tube 2 in the proximity of the air outlet port 3 is a connector element 6. This connector element has on its outside a housing 7 with an individually formed housing section 8 provided on the forward air outlet end of the connector element 6. Two contact slots 9 for connection with a further connector element are arranged at the forward end of the element 6.

The connector element 6 (FIGS. 2 and 3) is essentially comprised of the housing 7 described in the foregoing and contact bars 10 and contact terminals 11 arranged in the housing. In this arrangement, two contact bars 10 are equipped with equidistant apertures 13 and a contact tab 14 at their forward end in the proximity of the air outlet port 3 of the hair dryer. The contact terminals 11 have at their one end a scissors-type blade tap 15 and at their other end a contact tab 16.

Each two contact bars 10 are mounted on the outside of the heater tube 2 in parallel arrangement to each other, for example, by means of detent hooks clipping into corresponding openings in the heater tube. Provided between the two contact bars 10 is a slotted opening 17 into which the two blade taps of the contact terminal 11 are slid. The contact tabs 16 of the terminals 11 point in opposite directions and are push-fitted into the apertures 13 of the bars 10, being thus electrically connected therewith. The contact bars 10 and the contact terminals 11 are fabricated from an electrically conducting material, while the heater tube 2 and the housing 7 of the connector element 6 are made of an electrically insulating material, for example, plastic.

Figure 4:
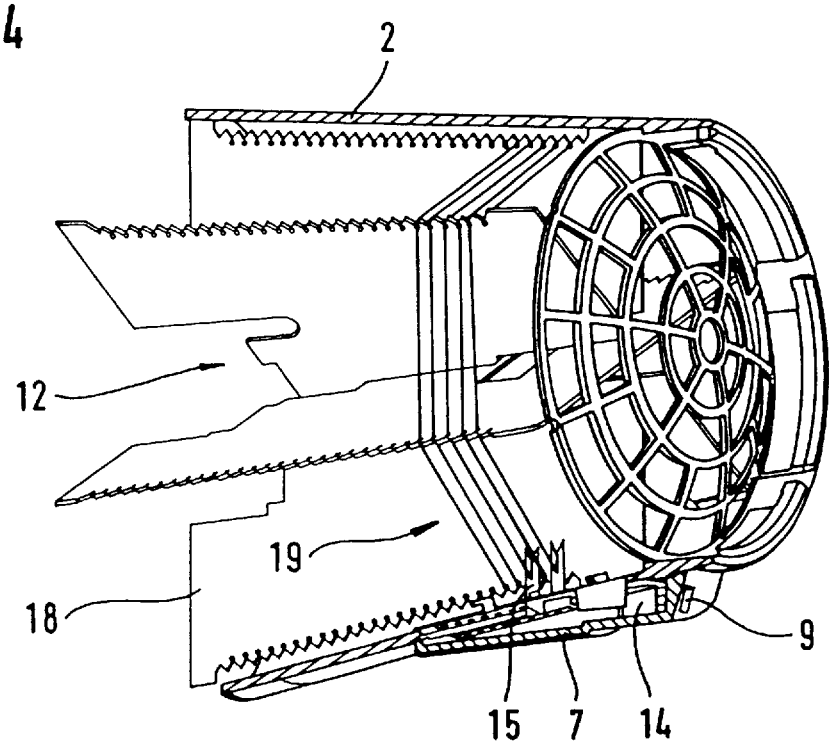
FIG. 4 is a partial sectional view of the air outlet end of the hair dryer of FIG. 1.

Received in the heater tube 2 (FIG. 4) is a heater unit 12 which is comprised of several heat conductor supports 18 and a heat conducting wire 19 wound around the supports. The distance between the individual turns of the heat conducting wire 19 corresponds to the distance between the apertures 13 in the contact bar 10. The length of the contact bar 10 is selected such as to correspond to the maximum distance from the first to the last turn of the heat conducting wire 19. This has the advantage of enabling the contact terminals 11 to be routed from outside through the slotted opening 17 of the heater tube 2 and to be seated onto a turn of the heat conducting wire 19 for electrical connection therewith. By means of the contact tabs 16 of the terminals 11, an electrical connection is established between the blade tap 15 and the contact bar 10. The contact bar 10 terminates at its forward end in a contact tab 14 which is electrically connectible with a further connector element through the contact slots 9 of the housing 7.

Figure 5:
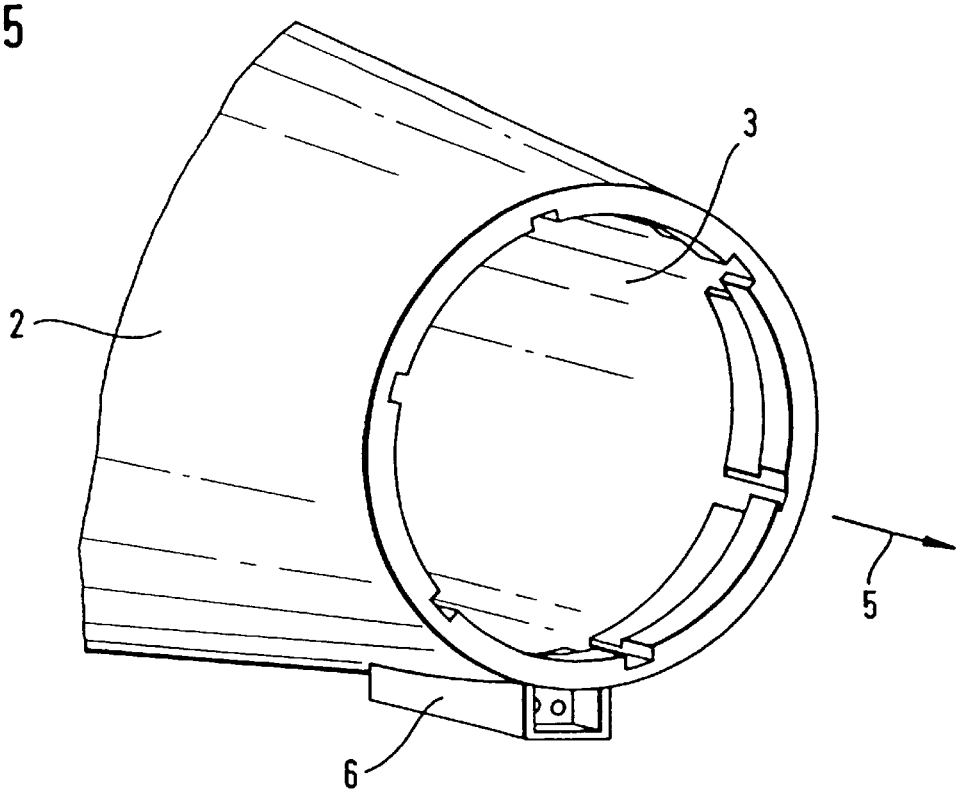
FIG. 5 is a perspective and schematic view of a heater tube for a hair dryer showing a connector element arranged on the outside thereof.

As shown, for example, in the preceding Figures, a connector element 6 of the present invention (FIG. 5) may be affixed to the outside of the heater tube 2. In such an arrangement, the forward end of the connector element 6 terminates approximately flush with the air outlet port 3 of the heater tube 2 through which air is adapted to flow in the flow direction 5.

Figure 6:
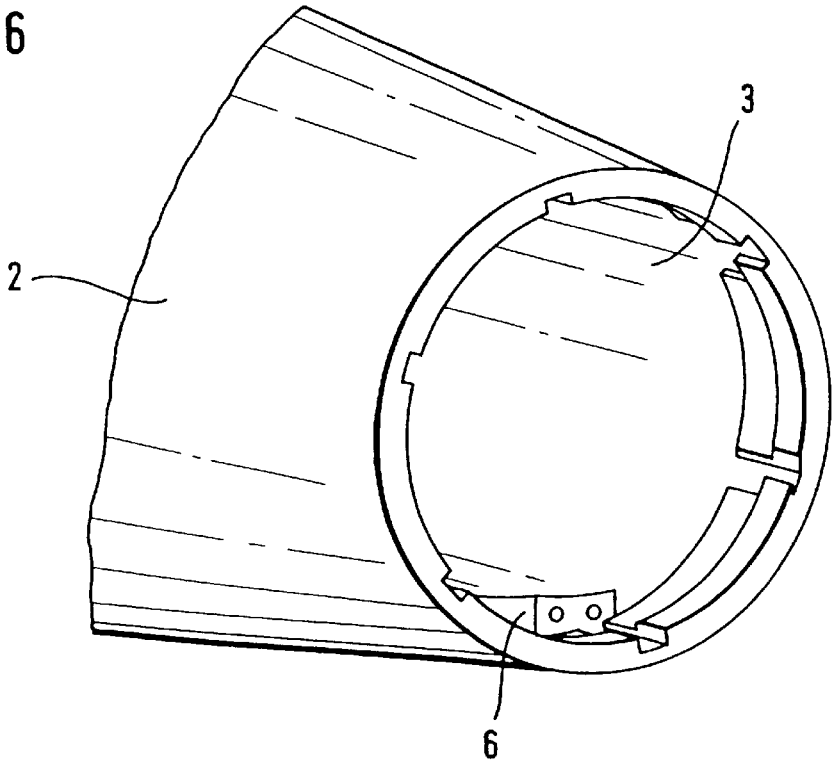
FIG. 6 is a view of the heater tube of FIG. 5 showing a connector element arranged on the inside thereof.
Figure 11:
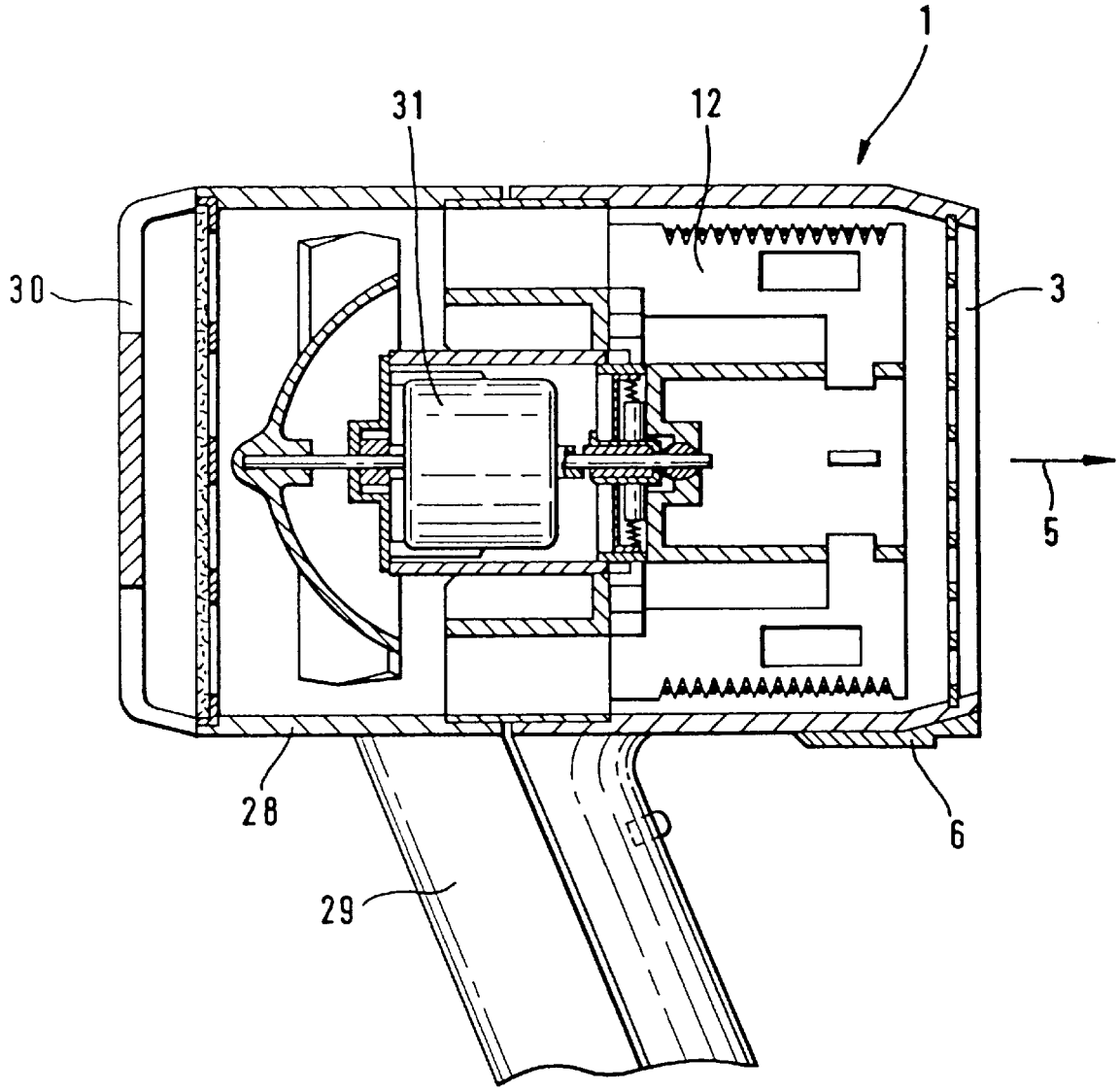
FIG. 11 is a schematic and sectional view of a hair dryer.

As an alternative to the above-described embodiment, it is however also possible for the connector element 6 to be affixed to the inside of the heater tube 2 and to terminate essentially flush with the air outlet port 3. In both embodiments of FIG. 5 and FIG. 6 it is also possible for the heater tube 2 to be enclosed from outside by an additional housing of the hair dryer (28, see FIG. 11).

Figure 7:
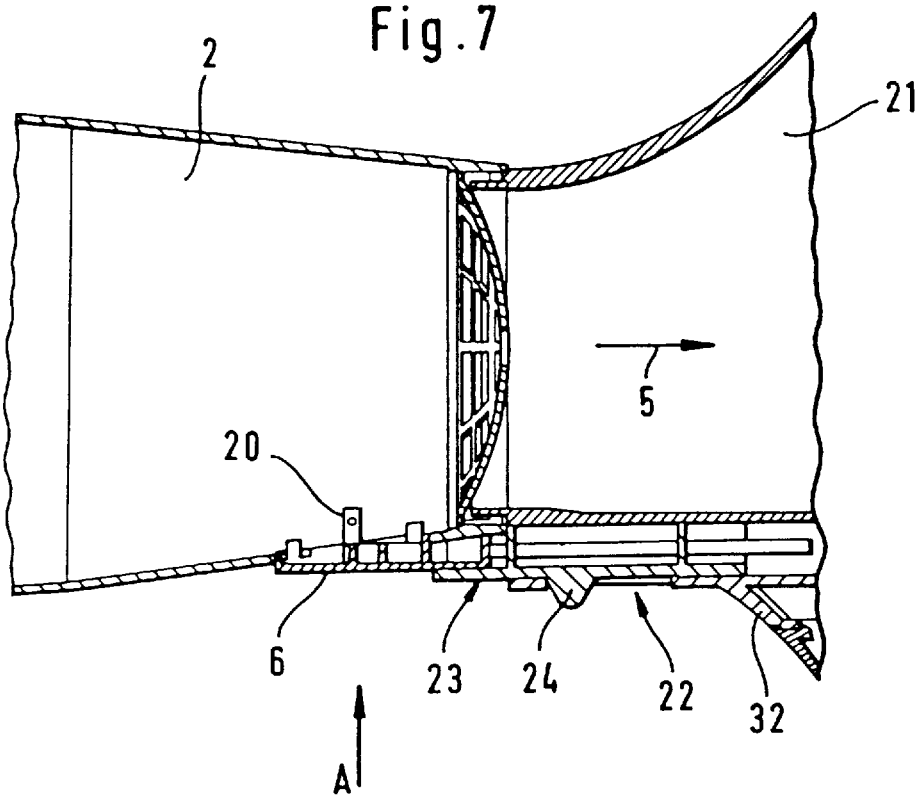
FIG. 7 is a schematic and sectional view of an air outlet end of a hair dryer showing an air inlet end of an implement and connector elements.

Two connector elements 6 and 22 are provided at the junction (FIG. 7) between the air outlet end of a heater tube 2 of a hair dryer and the air inlet end of an implement 21. The connector element 6 which is disposed at the air outlet end of the heater tube 2 corresponds substantially to the connector element 6 previously described. However, a contact tab 20 extends from the connector element 6 into the interior of the heater tube 2, so that this contact tab 20 is also connectible with a voltage-carrying part of the hair dryer other than the heater unit 12 previously described. The connector element 22 is fitted to the underside of the housing of the implement 21 and is equipped with a slide switch 23. This switch is slidable in a direction essentially parallel to the direction of main flow 5.

Figure 8:
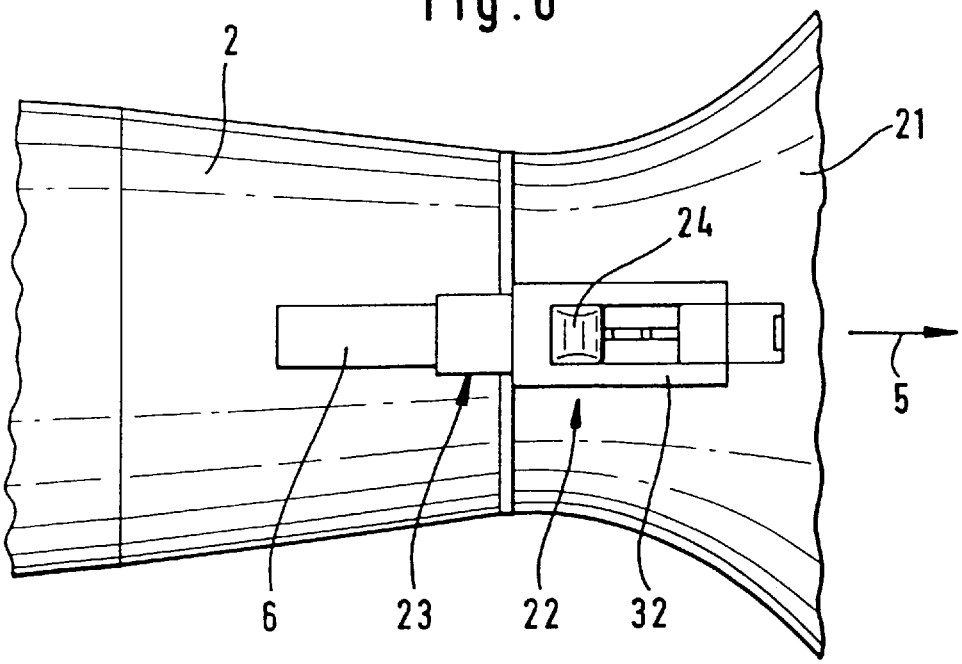
FIG. 8 is a view of a hair dryer and an implement as seen looking in the direction A of FIG. 7.

The slide switch 23 (FIG. 8) has a button 24 which is passed through an opening in the housing 32 of the connector element 22. On seating engagement of the implement 21 with the air outlet port of the heater tube 2, the slide switch 23 is slidable in the direction of the connector element 6 in opposition to the direction of main flow 5. This enables a mechanical connection to be established between the connector element 22 and the connector element 6. An implement 21 which is adapted to be seated and turned on the air outlet port of the heater tube 2, as by means of a bayonet catch, is thus mechanically protected by the slide switch 23 against disengagement by its own accord.

Figure 9:
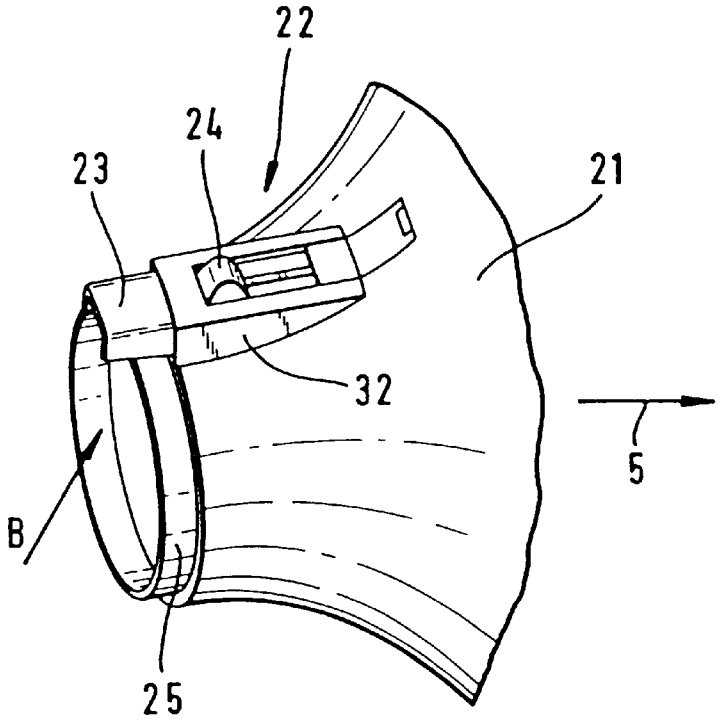
FIG. 9 is a perspective view of an air inlet end of the implement of FIG. 8.

The air inlet end of an implement 21 (FIG. 9) is comprised of an annular neck 25 adapted to be push-fitted onto the air outlet end of the heater tube 2. Adjoining this neck 25 in the direction of flow 5 is the casing of the implement 21 which is, for example, of a bell-shaped configuration. The housing 32 of the connector element 22 is arranged at the junction between the neck 25 and the casing of the implement 21. In this arrangement, the slide switch 23 is configured such as to protrude beyond the forward edge of the neck 25 in extended position.

Figure 10:
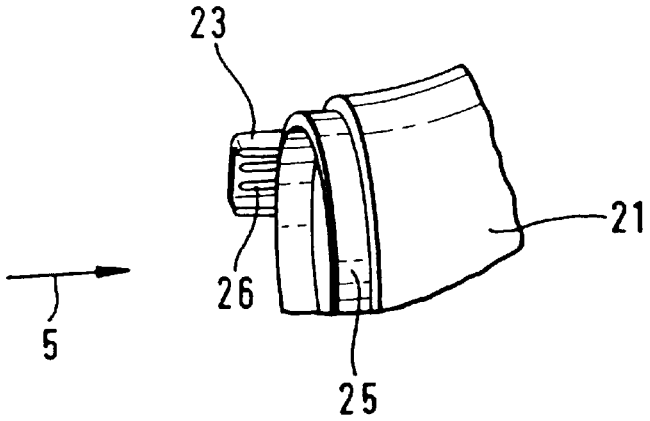
FIG. 10 is a perspective and fragmentary view of a slide switch as seen looking in the direction B of FIG. 9.

The slide switch 23 (FIG. 10) is essentially U-shaped in cross-section. Provided in the open interior of the switch 23 are contact pins 26 which can be connected electrically with the contact slots of a corresponding connector element. In this arrangement, the contact pins 26 are arranged essentially parallel to the direction of main flow 5 of the hair dryer and the implement 21.

A hair dryer 1 (FIG. 11) which is able to accommodate an implement of the type described in the foregoing is substantially comprised of a housing 28 with a handle 29. Received in the housing 28 are a heater unit 12 and a fan motor 31. Ambient air is aspirated into the housing 28 through the air inlet port 30, exiting the housing again in the direction of main flow 5 at the air outlet port 3. Provided on the underside of the housing 28 is a connector element 6 which is adapted to connect with an implement, not shown, of the type described in the foregoing.

Figure 2:
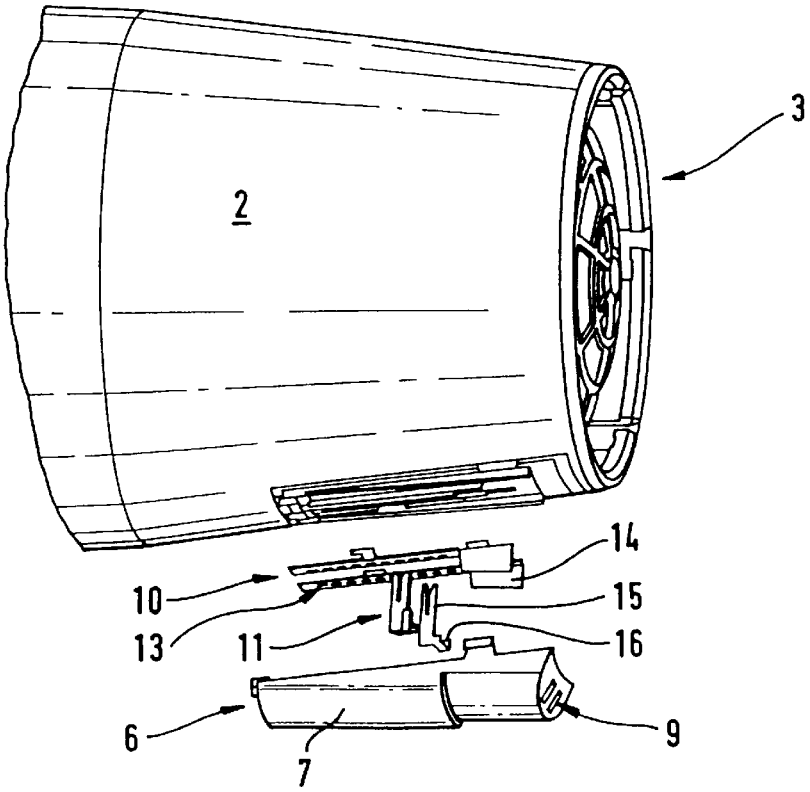
FIG. 2 is a view of the air outlet end of a hair dryer of FIG. 1 showing a connector element in exploded representation.
Figure 3:
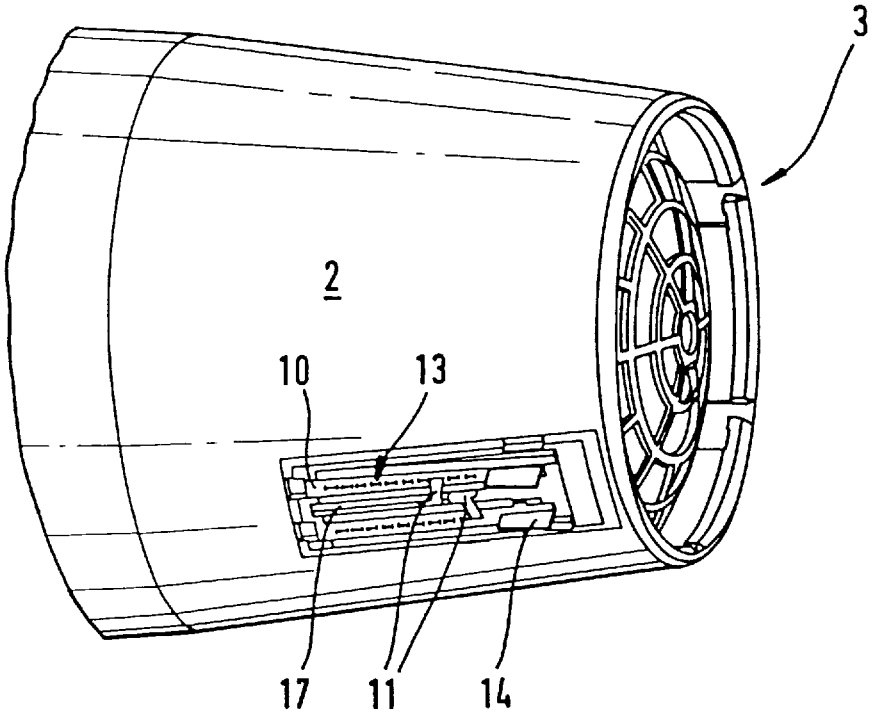
FIG. 3 is a view of the air outlet end of the hair dryer of FIG. 1 showing a connector element without its enclosure.
Figure 12:
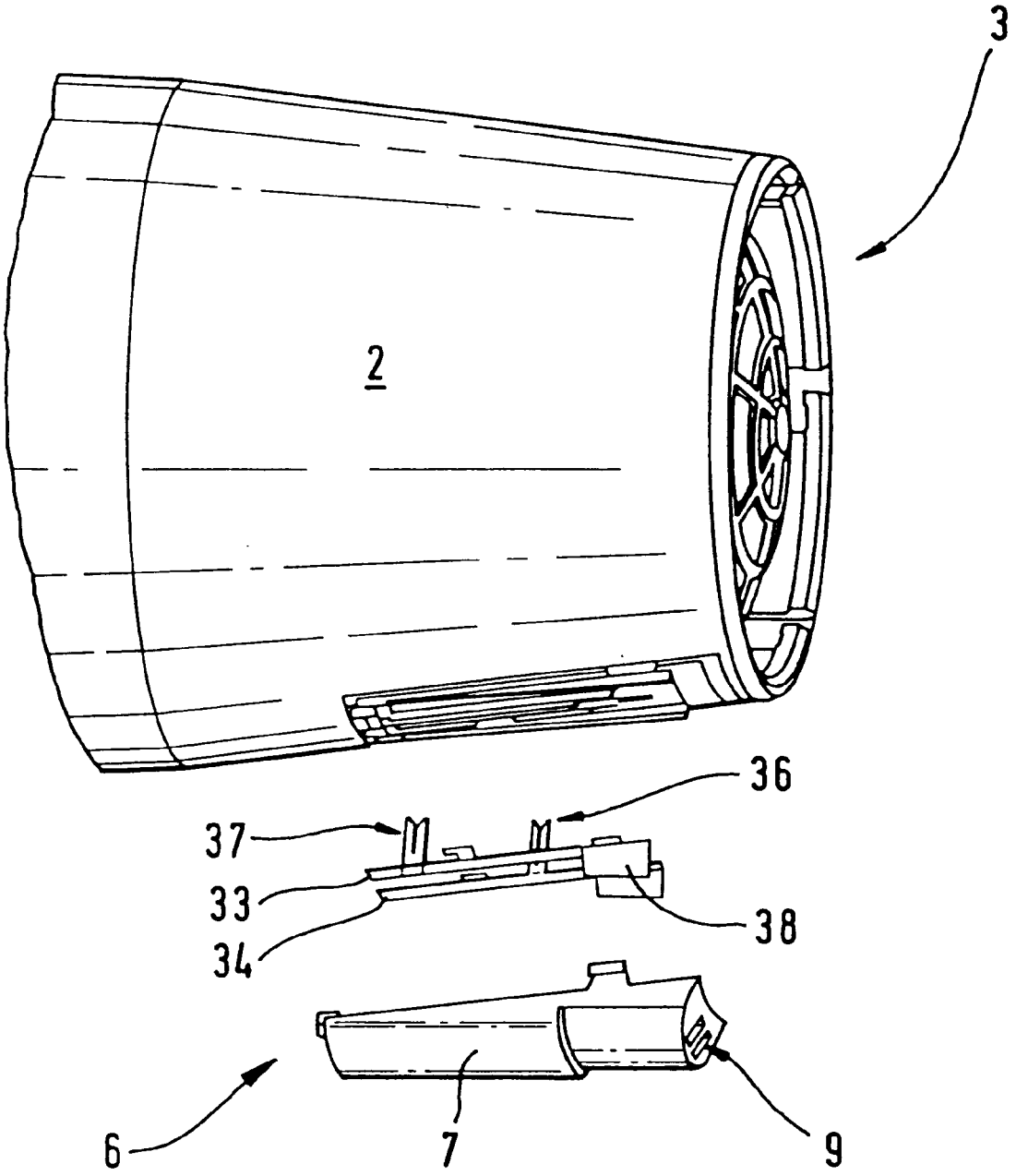
FIG. 12 is a view of the air outlet end of a hair dryer similar to FIG. 2 but showing a bar formed integrally with a contact terminal in exploded representation.

The connector element 6 (FIG. 12) is essentially comprised of the same components as described in the foregoing with reference to FIG. 2. Alternatively, however, the bars 33 and 34 are integrally formed with a respective contact terminal 36 and 37. In this embodiment, the contact terminals 36 and 37 are provided at different locations on the two bars 33 and 34, enabling the electric voltage to be adjusted to a particular value by means of the axial distance between the two contact terminals 36 and 37. A respective contact tab 38 is provided at the air outlet end of the bars 33, 34 for connection to a contact device of the additional implement. For assembly, the bars 33 and 34 are first inserted in the housing 7 and then clipped, together with the housing, onto the outer shell of the heater tube 2.

What is claimed is:

1. An electrically powered appliance for the treatment of hair comprising:

a housing with an air inlet port and an air outlet port;

a fan motor within the housing for generating the air current;

an electrically powered heater unit within the housing; and a connector element mounted on the outside of the housing and positioned to electrically connect with an electrical circuit of an implement when said implement is mounted over the outlet port of the housing said connector element including at least one terminal device which is electrically connected with directly to the heater unit within the housing.

2. The appliance for the treatment of hair as claimed in claim 1, wherein the terminal device is routed through the housing and extends into the interior of the housing where the terminal device electrically connects directly to the heater unit.

3. The appliance for the treatment of hair as claimed in claim 1, wherein the terminal device is an electric voltage tap using a standard component including standard variants.

4. The appliance for the treatment of hair as claimed in claim 1, wherein the terminal device comprises an electrically conducting bar and a contact terminal.

5. The appliance for the treatment of hair as claimed in claim 4 wherein the bar is configured as a straight bar.

6. The appliance for the treatment of hair as claimed in claim 4 wherein the housing includes a heater tube for directing the air current from the fan motor and the bar is secured to the outside of the heater tube.

7. The appliance for the treatment of hair as claimed in claim 4 wherein the heating wire is a spiral coil heater and wherein the bar is provided with contact points for fastening the contact terminal, with the distance between two contact points on the straight bar corresponding to the distance between two turns of the heating wire.

8. The appliance for the treatment of hair as claimed in claim 7 wherein the heating wire is a spiral coil heater and wherein the bar is helical with a lead corresponding to the lead of the spiral coil heater.

9. The appliance for the treatment of hair as claimed in any claim 4 wherein the bar has at one end a contact slot and a contact pin on a contact tab for electrically connecting to the implement.

10. The appliance for the treatment of hair as claimed in claim 4, wherein the heater unit has heat conducting wire and the contact terminal has an end formed in the manner of a blade tap having at least two blades and is push-fitted onto the heat conducting wire of the heater unit.

11. The appliance for the treatment of hair as claimed in claim 4, wherein the contact terminal includes an end having a contact tab which is connected with the bar.

12. The appliance for the treatment of hair as claimed in claim 4, wherein the bar and the contact terminal are constructed as die castings.

13. The appliance for the treatment of hair as claimed in claim 4, wherein the bar and the contact terminal are formed as an integral terminal device.

14. The appliance for the treatment of hair as claimed in claim 4, wherein the bar is connected to a component of the appliance that carries the supply voltage.

15. The appliance for the treatment of hair as claimed in claim 4, wherein the bar is configured as a helical bar.

16. The appliance for the treatment of hair as claimed in claim 4 wherein the bar and the contact terminal are constructed as sheet metal stampings.

17. The appliance for the treatment of hair as claimed in claim 1 wherein the housing includes a heater tube for directing the air current from the fan motor and said appliance further comprises a contact terminal and two straight contact bars arranged substantially parallel to the direction of air flow within the heater tube, and the contact terminal is insertable into a slotted opening in the heater tube between the two contact bars.

18. The appliance for the treatment of hair as claimed in claim 1 wherein the heater unit is located between the fan motor and the outlet port.

19. The appliance for the treatment of hair as claimed in claim 18 wherein the heater unit is a spiral coil heater.

20. The appliance for the treatment of hair as claimed in claim 19, wherein the spiral coil heater has a heat conducting wire and the terminal device has an end directly connected to the heat conducting wire of the the spiral coil heater.

21. The appliance for the treatment of hair as claimed in claim 1 wherein the connector element is a female connector element designed to receive electrical contacts from the implement.

* * * * *

UNITED STATES PATENT AND TRADEMARK OFFICE

CERTIFICATE OF CORRECTION

PATENT NO. : 6,222,988 B1
DATED : April 24, 2001
INVENTOR(S) : Jurgen Behrendt and Wilfried Rolf It is certified that error appears in the above-identified patent and that said Letters Patent is hereby corrected as shown below:

Column 7,
Line 26, delete “with”.

Column 8,
Line 4, delete “any”.

Signed and Sealed this

Twenty-sixth Day of November, 2002

*Attest:*

*Attesting Officer*

JAMES E. ROGAN
*Director of the United States Patent and Trademark Office*